US009611070B2

(12) United States Patent
Ma

(10) Patent No.: US 9,611,070 B2
(45) Date of Patent: Apr. 4, 2017

(54) CONTAINER BUILT-IN MOVABLE COMBINED TRAY WITH LENGTH AND WIDTH EXTENSIBLE

(71) Applicant: Jijun Ma, Xuancheng Langxi (CN)

(72) Inventor: Jijun Ma, Xuancheng Langxi (CN)

( * ) Notice: Subject to any disclaimer, the term of this patent is extended or adjusted under 35 U.S.C. 154(b) by 35 days.

(21) Appl. No.: 14/436,587

(22) PCT Filed: Oct. 16, 2013

(86) PCT No.: PCT/CN2013/085321

§ 371 (c)(1),
(2) Date: Apr. 17, 2015

(87) PCT Pub. No.: WO2014/059932

PCT Pub. Date: Apr. 24, 2014

(65) Prior Publication Data

US 2015/0266612 A1 Sep. 24, 2015

(30) Foreign Application Priority Data

Oct. 18, 2012 (CN) ..... 2012 1 0397185
Oct. 18, 2012 (CN) ..... 2012 1 0397187

(51) Int. Cl.
*B65D 19/00* (2006.01)
*B65D 88/00* (2006.01)
(Continued)

(52) U.S. Cl.
CPC ..... *B65D 19/0093* (2013.01); *B65D 88/005* (2013.01); *B65D 88/129* (2013.01);
(Continued)

(58) Field of Classification Search
CPC ..... B65D 88/129; B65D 2590/005; B65D 90/006; B65D 90/18; B65D 88/005;
(Continued)

(56) References Cited

U.S. PATENT DOCUMENTS 3,010,409 A * 11/1961 De Good
Maynard ..... B65G 13/00 104/135
4,976,365 A 12/1990 Seo
(Continued)

FOREIGN PATENT DOCUMENTS

CN 1714030 12/2005
CN 201559853 8/2010
(Continued)

*Primary Examiner* — Glenn Dayoan
*Assistant Examiner* — Sunsurraye Westbrook
(74) *Attorney, Agent, or Firm* — Jeanette Meng Nakagawa

(57) ABSTRACT

The present invention is a movable pallet for loading and securing goods into and out of a shipping container. The dimensions of the movable pallet can be conveniently and selectively adjusted both in length and in width. These adjustments can be further secured by removable locking devices at various locations along the side of the movable pallet, as well as around all of its corners. The versatile adjustment mechanism of the present invention allows goods to be securely transferred among containers of various dimensions during maritime and land transportation.

11 Claims, 3 Drawing Sheets

(51) Int. Cl.
*B65D 88/12* (2006.01)
*B65D 90/18* (2006.01)

(52) U.S. Cl.
CPC .... *B65D 90/18* (2013.01); *B65D 2519/00273* (2013.01); *B65D 2519/00761* (2013.01)

(58) Field of Classification Search
CPC .... B65D 88/022; B65D 88/123; B61D 15/06; B61D 17/02; B61D 17/06; B61D 17/08; B61D 17/22
USPC ..... 206/386, 598; 410/46, 66, 84; 105/15, 105/392.5; 220/1.5, 23.4
See application file for complete search history.

(56) References Cited

U.S. PATENT DOCUMENTS

D398,434 S * 9/1998 Agtuca ..... D34/23
7,201,243 B2 * 4/2007 Konstant ..... B62B 3/00 180/20
7,517,180 B2 * 4/2009 Baker ..... B65D 88/129 410/46
8,491,240 B2 * 7/2013 Baker ..... B65D 90/18 410/66
2007/0017421 A1 1/2007 Kumpel
2008/0250986 A1 10/2008 Boon
2013/0139735 A1 * 6/2013 Ma ..... B65D 88/129 108/57.15
2013/0327735 A1 * 12/2013 Gronholm ..... B65D 19/0095 211/85.8

FOREIGN PATENT DOCUMENTS

CN 101891046 11/2010
CN 201784968 4/2011
CN 201784970 4/2011
CN 102264605 11/2011
CN 202848429 4/2013

* cited by examiner

CONTAINER BUILT-IN MOVABLE COMBINED TRAY WITH LENGTH AND WIDTH EXTENSIBLE

TECHNICAL FIELD

The present invention relates to the container transportation technology field, in particular a container built-in movable combined pallet with extensible length and width.

TECHNICAL BACKGROUND

To prepare a shipping container for transporting bulky and heavy goods, the goods should be conveyed or hoisted into containers and then firmly fixed. "U.S. Pat. No. 4,976,365—Pallet and container integrated with pallet" discloses a removable pallet with bottom rollers. According to the patent, we can first convey and fix goods or packing containers to the pallet firstly, push the pallet into shipping container and then firmly lock the pallet and the container. The international patent—"PCT/CN2011/077352—container built-in movable pallet" I applied for, discloses a guide roller structure set on the sides and front edge corners of pallet as well as snap structured locking device set in the rear edge corners of pallet. The guide roller structure may prevent damage or even laceration to the container wall, thus effectively protect the container. In addition, it has features of high strength, flexible rolling and ability to bear great impact. Simply by tightening the tightening handle, the locking device may achieve firm tightening effect. Thus, operation is rather easy and the locking effect is highly reliable.

The dimensions of current common shipping containers that meet international standard are 40 feet in length and 88 feet (2235 mm) in width. However, in North America, in addition to using the size of containers, containers of 45 feet (2235 mm wide), 48 feet (2550 mm wide) and 53 wide feet (2550 mm) are also widely used as land transportation containers suitable for highway and railway transportation. Therefore, the built-in movable pallet manufactured for standard shipping containers cannot be used in these land transportation containers of non-uniform dimensions as no effective positioning and locking can be performed.

DISCLOSURE OF THE INVENTION

Aiming at solving the disadvantage of above-mentioned existing pallet as they are not suitable for land transportation containers of different dimensions, the applicant provides a reasonable structure container built-in movable combined pallet with extensible length and width that can be flexibly applied to ocean freight containers and land transportation containers of a variety of specifications.

Technical solution applied in the invention is as follows:

A kind of container built-in movable combined pallet with extensible length and width, where the guide roller is set on both sides and front edge corner of pallet with roller fitted rectangular chassis and the locking device is set in the rear edge corners of rectangular chassis. At least one of the front and rear sides of rectangular chassis should be installed with extension portion and the guide roller described is the guide roller assembly that can rotate around the pivot of the rotating shaft hole.

As a further improvement of the above-mentioned technical solution, the rectangular chassis has a first and a second extension portion along all of its sides.

As a further improvement of the above-mentioned technical solution: the extension portion described is of a flip folding structure. End face on one side of the extension portion is pin-jointed with the rectangular chassis with the trip shaft. Plugs are set in the extension portion and fixing holes are set on both sides of the trip shaft on rectangular chassis at equal distance. The plugs and fixing holes are matched respectively in folded state and open state.

Reversible folding rollers are provided in the extension portion.

The extension portion described is of a detached or hidden structure.

Fixed set in the middle of the guide rollers is welded to the pallet side channel steel and the outer ring gap of guide rollers is fitted in the periphery of the inner shaft, the inner shaft is fixed to one side between the top plate and the bottom plate; the rotating shaft is fixed to the other side between the top plate and the bottom plate and the gap is fitted in the rotating shaft hole in the fixed seat; locating pin is set in the fixed seat and the first pin hole and the second pin hole set in the top plate will respectively match the location pin when they are unscrewed and screwed in; after assembly, the guide rollers, top plate, bottom plate and rotating shaft form an integral rotation unit and the rotating shaft may rotate and move up and down in the rotating shaft hole.

The locking device descried is set with lateral sliding guide rail and the guide rail used is conduit nested in the square tube in the tail end of the pallet.

Beneficial effects of the present invention are as follows:

In the present invention, existing standard shipping container built-in movable pallet is reformed to combined pallet. Due to convenient adjustment of length and width, the pallet may be flexibly applied in a variety of specifications of maritime and land transportation containers. In actual use, all alignments are completed in three steps: 1. length combination: combine two extension parts of different lengths in the front and rear ends of combined pallet in different manners (rotating, folding, embedded drawing etc.) to conveniently and rapidly obtain the built-in length dimensions of four kinds of containers; folding rollers set in the extension portion may realize effective supporting and sliding; 2. width adjustment: using a specially designed rotatable guide rollers assembly, as well as the combined action of a locating pin and two locating pin holes to manually lift, rotate and achieve dropping down and self-locking under the effect of gravity to complete adjustment of two different widths; 3. built-in locking: the locking device with side slipping and displacement function may lock pallet of different container widths. The present invention has features of simple and reasonable structure, good bearing, low manufacturing cost, convenient and efficient operation and excellent universality and compatibility and can be flexibly adapted to interoperability requirements of the world's major economies that follow different container standards.

BRIEF DESCRIPTION OF APPENDED FIGURES

In the figure, 1. rectangular chassis; 2. the second extension portion; 3. the first extension portion; 31. folding roller; 40. fixed locking device; 41. slidable locking device; 5. guide roller assembly; 6. trip shaft; 7. plug; 11. channel steel; 12. square tube; 42. conduit; 50. locating pin; 51. outer ring; 52. top plate; 53. bottom plate; 54. the first pin hole; 55. the second pin hole; 56. rotating shaft; 57. fixed seat; 58. inner shaft; 59. rotating shaft.

Concrete Implementation Manner

Concrete implementation manner of the present invention is explained combining appended diagrams.

Figure 1:
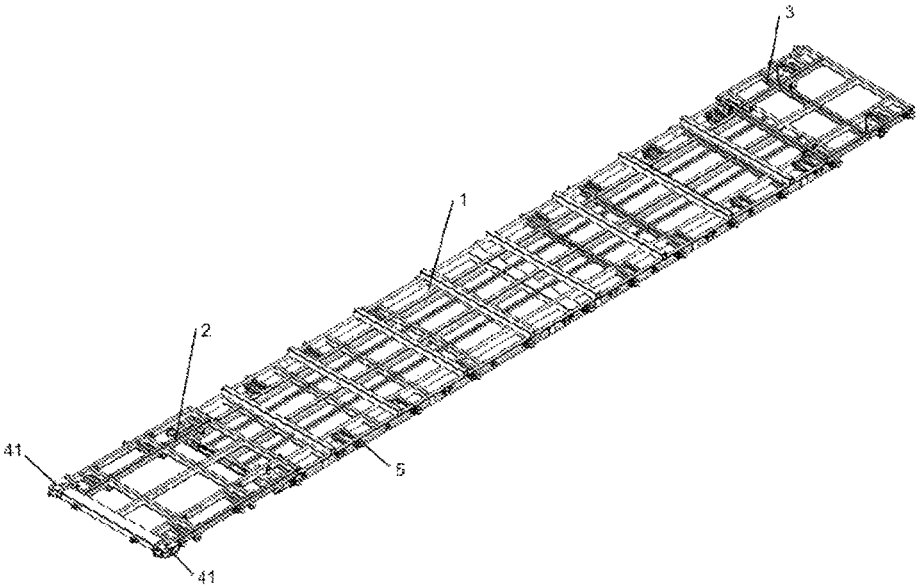
FIG. 1 is a solid diagram of the present invention in fully open state.
Figure 2:
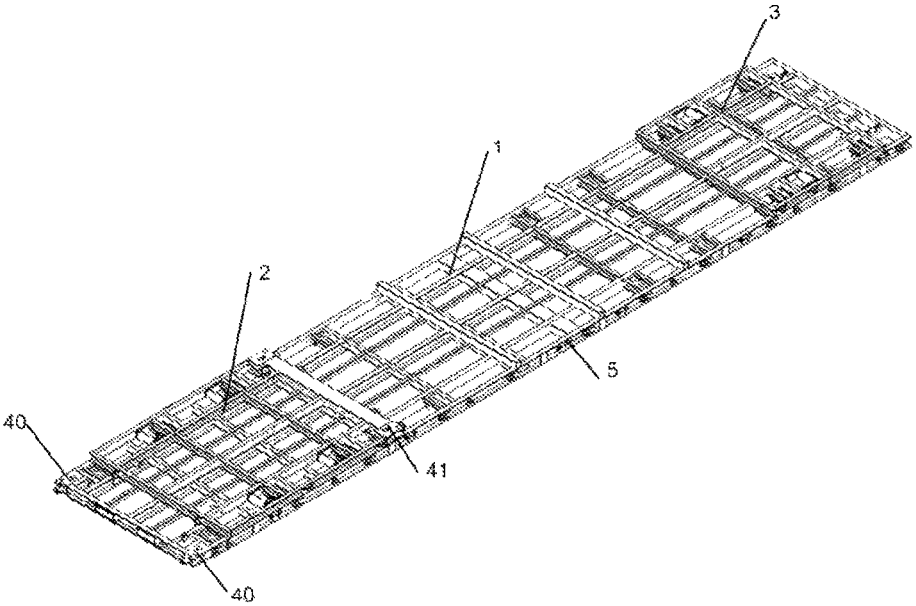
FIG. 2, is the same as FIG. 1, but in folded state.

As shown in FIG. 1, container built-in movable combined pallet with extensible length and width (hereinafter referred to as "combined pallet") described in the present invention is formed by adding the first extension portion 3 and the second extension portion 2 respectively on front and rear sides of the rectangular chassis 1 of standard pallet. When extension portions on both sides are folded, standard pallet is appropriate for 40 feet long maritime containers; when the first extension portion 3 is unfolded and the second extension portion 2 is folded, the total length of pallet is increased by 5 feet, thus appropriate for 45 feet long land transport containers; when the second extension portion 2 is unfolded and the first extension portion 3 is folded, the total length of pallet is increased by 8 feet, thus appropriate for 48 feet long land transport containers; and when extension portions on both sides are unfolded, as shown in FIG. 2, the total length of pallet is increased by 13 feet, thus appropriate for 53 feet long land transport containers.

Figure 3:
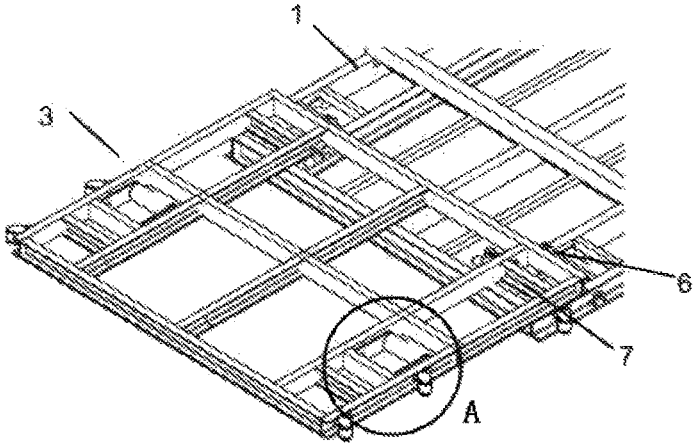
FIG. 3 is the partial view of the upturned extension portion of the present invention.

The extension portion has a variety of extension means: for example, using a separate extension portion, perform assembly connection by connecting the extension portion to locking device. Or use guide rail and sliding block to hide the extension portion in the rectangular chassis 1 and move out the extension portion when we require using it to achieve the required length dimension. In the embodiments as shown in FIG. 1 and FIG. 2, the present invention provides a flip foldable extending means of extension portion. As shown in FIG. 3, end face on one side of the extension portion 3 is pin-jointed with the rectangular chassis 1 with the trip shaft 6. Plug 7 is set in the first extension portion 3 and fixing holes are set on both sides of the trip shaft 6 on rectangular chassis 1 at equal distance. The plug 7 and fixing holes are matched respectively in folded state and open state, so as to realize extension of the extension portion.

Figure 4:
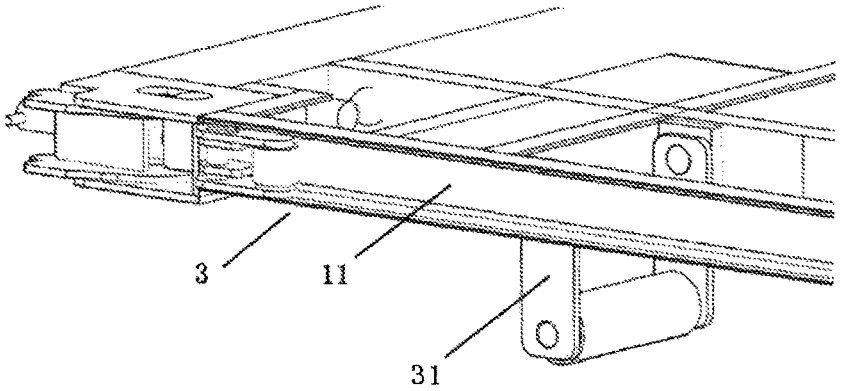
FIG. 4 is the enlarged view of part A in FIG. 3.

As shown in FIG. 4, extension portion in the present invention is fitted with reversible folding roller 31. When the extension portion is folded, the folding roller 31 can be overturned and placed in the thickness plane of the extension portion; when the extension portion is unfolded, folding roller 31 will be overturned to be perpendicular to the thickness plane of the extension portion and fastened. The roller is in tact with the ground, forming effective support for the pallet.

Figure 5:
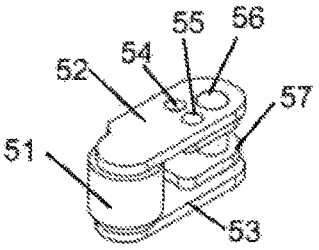
FIG. 5 is the solid diagram of the guide wheel assembly in the present invention.
Figure 6:
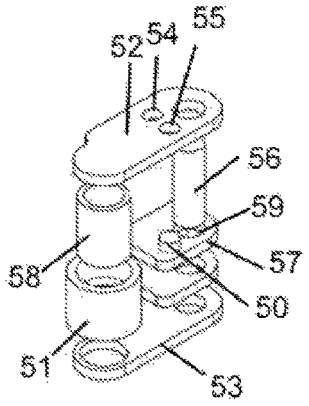
FIG. 6 is an exploded view of FIG. 5.
Figure 7:
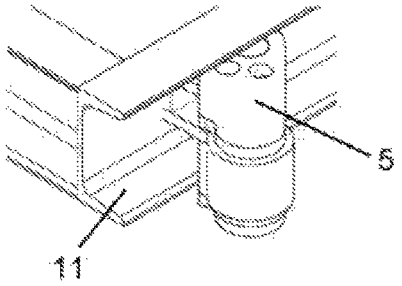
FIG. 7 is the state diagram of the unscrewed and opened side guide roller assembly in the present invention.

The internal width of 40 feet and 45 feet containers is 2235 mm and the internal width of 48 feet and 53 feet containers is 2550 mm. In order to adapt to the two different width dimensions, the present invention adopts a guide wheel assembly 5 that can be rotated and opened from the side. As shown in FIG. 5 to FIG. 7, fixed seat 57 in the middle of the guide roller assembly 5 is welded to the rectangular chassis 1 and the "[" shaped channel steel 11 in extension portions of both sides. The outer ring 51 gap of guide roller is fitted in the periphery of the inner shaft 58. Add lubricating grease to enable friction and lubrication; the inner shaft 58 is fixed to one side between the top plate 52 and the bottom plate 53; the rotating shaft 56 is fixed to the other side between the top plate 52 and the bottom plate 53 and the gap is fitted in the rotating shaft hole 59 in the fixed seat 57. Locating pin 50 is set in the fixed seat 57 and the first pin hole 54 and the second pin hole 55 set in the top plate 52 will respectively match the location pin 50 when they are unscrewed and screwed in. After assembly, the guide roller, top plate 52, bottom plate 53 and rotating shaft 56 form an integral rotation unit and the rotating shaft 56 may rotate and move up and down in the rotating shaft hole 59.

As shown in FIG. 6, the imbedded status of guide rollers assembly 5 is its initial state, and in this state, the second pin hole 55 and the locating pin 50 match each other for positioning. When the guide rollers assemblies 5 on both sides are completely imbedded in the open slot of channel steel 11, the maximum width of the entire pallet is 2235 mm and the distance between the peripheral farthest points of the outer ring 51 of guide rollers assemblies 5 on both sides. This may meet internal width requirements of 40 feet and 45 feet containers.

Manually lift the rotating unit to disengage the second pin hole 55 and the locating pin 50. The top plate 52 is rotating above the top face of the locating pin 50 along the axis—the rotating shaft 56 to unscrew from the open slot of the channel steel 11. When the first pin hole 54 is above the locating pin 50, the rotating unit will drop down under the gravity action. Then the first pin hole 54 and the locating pin 50 match each other for positioning. As shown in FIG. 7, the guide rollers assembly 5 and the channel steel 11 are opened to form a certain angle. When the guide rollers assemblies 5 on both sides are completely unscrewed, the maximum width of the entire pallet is 2550 and the distance between the peripheral farthest points of the outer ring 51 of guide rollers assemblies 5 on both sides. This may meet internal width requirements of 48 feet and 53 feet containers.

In the present invention, a locating is matched respectively with two pin holes. Manually unscrew to drop down and achieve self-lock of the pallet under gravity action. The pallet has features of simple and reasonable structure, rapid and convenient operation, high strength and fastness. Thus it may completely satisfy the use condition requirements of guide rollers and achieve accurate and convenient adjustment of movable pallet width.

Figure 8:
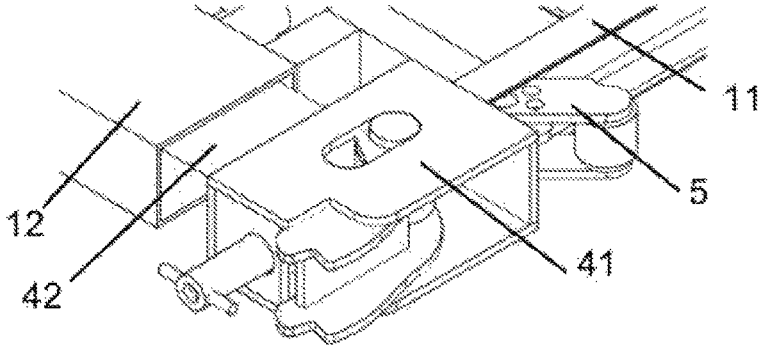
FIG. 8 is the solid diagram of the slidable locking device in the present invention.

In the present invention, a fixed locking device 40 is set in the tail end of the rectangular chassis 1 and may meet the locking requirements of 40 feet and 45 feet containers as internal width of both container specifications is 2235 mm. Meanwhile, a slidable locking device 41 that can slide outward may be set in the tail end of the second extension portion 2. As shown FIG. 8, when the second extension portion 2 is overturned and opened, the slidable locking device 41 will slide out through the conduit 42 in the square tube 12 nested in the tail end of pallet and achieve positive stop and locking when it reaches the outer side, thus meeting the locking requirements of 48 feet and 53 feet containers as internal width of both container specifications is 2550 mm. For locking principle and structure of the locking device, please refer to "PCT/CN2011/077352—container built-in movable pallet".

The above description is the explanation of the present invention but not limitation of the invention. For scope limited for the present invention, please refer to the Patent Claim. On the premise that the spirit of the invention is not violated, the invention may be modified in any way, for example, to adjust the width of entire pallet by sliding one side channel steel.

What is claimed is:

1. A movable pallet for loading and securing goods into and out of a container, the pallet comprising:

a rectangular base chassis (1) with a first extension (3) from a front edge of the chassis positioned to enter the container, and a second extension (2) from an opposing rear edge of the chassis, wherein the first and second extensions (3, 2) are selectively folded and unfolded via at least one pair of trip shafts (6) and are secured into positions via corresponding plugs (7);

at least one set of fixed locking devices (40) installed at both rear corners formed between the rear edge and both side edges of the rectangular base chassis (1); and at lease one set of guide roller assemblies (5) installed within steel side channels (11) along both side edges of the rectangular base chassis, and at both front corners formed between the front edge and both side edges of the rectangular base chassis, wherein the guide roller assembly (5) further comprising:

a fixed seat (57) secured within an enclosure of the steel side channel (11);

a top plate (52) in parallel to a bottom plate (53), and are connected at a first end via a rotating shaft (56) through a rotating shaft hole (59) on the fixed seat (57), wherein the rotating shaft (56) is allowed to rotate around an axis of rotation connecting the top and bottom plate through a center of the rotating shaft hole (59), and to move along the axis;

the top and bottom plates are connected at a second end via an inner shaft (58) with an outer ring (51) rotating around the inner shaft; and a locating pin (50) secured onto the fixed seat (57) to match with a first pin hole (54) on the top plate (52) when the guide roller assembly is tugged along and within the enclosure of the steel side channel's (11), and to match with a second pin hole (55) on the top plate (52) when the guide roller assembly extends outside of the enclosure of the steel side channel's (11).

2. The movable pallet of claim 1, wherein the first and second extensions (3, 2) are fitted with at least one pair of reversible folding rollers (31).

3. The movable pallet of claim 1, wherein the first and second extensions (3, 2) are selectively detachable from the rectangular base chassis (1).

4. The movable pallet of claim 1, wherein the first and second extensions (3, 2) are selectively secured onto an underside of the rectangular base chassis (1) while in a folded position.

5. The movable pallet of claim 1, wherein the fixed locking device (40) is converted into a slidable locking device (41) and is removably installed by inserting a conduit (42), attached to a side surface of the slidable locking device (41), into a square tube (12) along edges of the first and second extensions (3, 2).

6. A movable pallet for loading and securing goods into and out of a container, the pallet comprising:

a rectangular base chassis (1) with a first extension (3) from a front edge of the chassis positioned to enter the container, and a second extension (2) from an opposing rear edge of the chassis, wherein the first and second extensions (3, 2) are selectively extended or retracted into the rectangular base chassis (1) via a pair of guide rails parallel to both side edges of the rectangular base chassis (1);

at least one set of fixed locking devices (40) installed at both rear corners formed between the rear edge and both side edges of the rectangular base chassis; and at lease one set of guide roller assemblies (5) installed within steel side channels (11) along both side edges of the rectangular base chassis, and at both front corners formed between the front edge and both side edges of the rectangular base chassis, wherein the guide roller assembly (5) further comprising:

a fixed seat (57) secured within an enclosure of the steel side channel (11);

a top plate (52) in parallel to a bottom plate (53), and are connected at a first end via a rotating shaft (56) through a rotating shaft hole (59) on the fixed seat (57), wherein the rotating shaft (56) is allowed to rotate around an axis of rotation connecting the top and bottom plate through a center of the rotating shaft hole (59), and to move along the axis;

the top and bottom plates are connected at a second end via an inner shaft (58) with an outer ring (51) rotating around the inner shaft; and a locating pin (50) secured onto the fixed seat (57) to match with a first pin hole (54) on the top plate (52) when the guide roller assembly is tugged along and within the enclosure of the steel side channel's (11), and to match with a second pin hole (55) on the top plate (52) when the guide roller assembly extends outside of the enclosure of the steel side channel's (11).

7. The movable pallet of claim 6, wherein the first and second extensions (3, 2) are fitted with at least one pair of reversible folding rollers (31).

8. The movable pallet of claim 6, wherein the first and second extensions (3, 2) are selectively detachable from the rectangular base chassis (1).

9. The movable pallet of claim 6, wherein the first and second extensions (3, 2) are selectively secured onto an underside of the rectangular base chassis (1) while in a retracted position.

10. The movable pallet of claim 6, wherein the fixed locking device (40) is converted into a slidable locking device (41) and is removably installed by inserting a conduit (42), attached to a side surface of the slidable locking device (41), into a square tube (12) along edges of the first and second extensions (3, 2).

11. A movable pallet for loading and securing goods into and out of a container, the pallet comprising:

a rectangular base chassis (1) with a first extension (3) from a front edge of the chassis positioned to enter the container, and a second extension (2) from an opposing rear edge of the chassis, wherein the first and second extensions (3, 2) are selectively extended beyond the front and rear edges of the base chassis (1);

at least one set of fixed locking devices (40) installed at both rear corners formed between the rear edge and both side edges of the rectangular base chassis (1);

at least one set of slidable locking devices (41) removably installed by inserting a conduit (42), attached to a side surface of the slidable locking device (41), into a square tube (12) along edges of the first and second extensions (3, 2); and at least one set of guide roller assemblies (5) installed within steel side channels (11) along both side edges of the rectangular base chassis, and at both front corners formed between the front edge and both side edges of the rectangular base chassis, wherein the guide roller assembly (5) further comprising:

a fixed seat (57) secured within an enclosure of the steel side channel (11);

a top plate (52) in parallel to a bottom plate (53), and are connected at a first end via a rotating shaft (56) through a rotating shaft hole (59) on the fixed seat (57), wherein the rotating shaft (56) is allowed to rotate around an axis of rotation connecting the top and bottom plate through a center of the rotating shaft hole (59), and to move along the axis;

the top and bottom plates are connected at a second end via an inner shaft (58) with an outer ring (51) rotating around the inner shaft; and a locating pin (50) secured onto the fixed seat (57) to match with a first pin hole (54) on the top plate (52) when the guide roller assembly is tugged along and within the enclosure of the steel side channel's (11), and to match with a second pin hole (55) on the top plate (52) when the guide roller assembly extends outside of the enclosure of the steel side channel's (11).

* * * * *